United States Patent [19]

Taki et al.

[11] Patent Number: 4,901,541

[45] Date of Patent: Feb. 20, 1990

[54] NEEDLE SELECTOR FOR KNITTING MACHINE

[75] Inventors: Yukio Taki, Konan; Norihiro Osawa, Kani, both of Japan

[73] Assignee: Okuma Machinery Works Ltd., Nagoya, Japan

[21] Appl. No.: 181,961

[22] Filed: Apr. 15, 1988

[30] Foreign Application Priority Data

Apr. 20, 1987 [JP] Japan ..... 62-97059

[51] Int. Cl.[4] ..... D04B 15/78; D04B 9/06

[52] U.S. Cl. ..... 66/220; 66/25; 66/222

[58] Field of Search ..... 66/25, 75.2, 219, 220, 66/221, 222

[56] References Cited

U.S. PATENT DOCUMENTS

| | | | |
|---|---|---|---|
| 3,283,541 | 11/1966 | De Cerjat | 66/220 |
| 3,851,500 | 12/1974 | Wolfshagen | 66/220 |
| 4,541,254 | 9/1985 | Schindele et al. | 66/223 |

FOREIGN PATENT DOCUMENTS

| | | | |
|---|---|---|---|
| 2155196 | 5/1973 | Fed. Rep. of Germany | 66/220 |
| 42-20439 | 10/1967 | Japan . | |
| 43-4557 | 1/1968 | Japan . | |
| 51-102151 | 9/1976 | Japan . | |
| 52-25463 | 7/1977 | Japan . | |
| 53-1865 | 1/1978 | Japan . | |
| 1112599 | 3/1966 | United Kingdom . | |
| 1047402 | 11/1966 | United Kingdom . | |
| 1208738 | 10/1970 | United Kingdom | 66/220 |
| 1264355 | 2/1972 | United Kingdom . | |
| 2164667 | 3/1986 | United Kingdom | 66/220 |

*Primary Examiner*—Wm. Carter Reynolds

*Attorney, Agent, or Firm*—Darby & Darby

[57] ABSTRACT

In a knitting machine, a needle selector having jacks fitted respectively in needle grooves formed in one of a cylinder, a dial and a needle bed is provided. A jack groove cam has a raising cam face for moving the jacks along their respective axes. A control electromagnet is arranged in facing relation to one of the jacks at a yarn feeding position on a stationary side. The control electromaget is excited in response to a needle-selecting signal to attract the jack to bring its butt into engagement with the raising cam face. A jack holding cam is arranged in juxtaposed relation to the other rocking end of the jack at the yarn feeding position. The jack holding cam has a cam face which is so magnetized as to attract the jack toward the jack groove cam. A welt cam is arranged at such a position as to clamp the jack between the cam face of the jack holding cam and a cam face of the welt cam, which is magnetized to attract the jack. Needle selection is carried out with respect to the jacks passing between both the cams, in response to presence and absence of the needle-selecting signal.

7 Claims, 7 Drawing Sheets

NEEDLE SELECTOR FOR KNITTING MACHINE

BACKGROUND OF THE INVENTION

The present invention relates to a needle selector for a knitting machine having incorporated therein a pattern-knitting apparatus of electronically controlled type in which electromagnets are operative in response respectively to needle-selecting signals to carry out needle selection.

FIGS. 8 and 9 show, as a first example, a known needle selector for a circular knitting machine, as disclosed, for example, in Japanese Patent Publication No. 42-20439 filed claiming the priority rights based on West German Application Nos. M64179 and M64421 both filed on Mar. 6, 1965, and corresponding to British Specification No. 1,112,59. In the known needle selector, a multiplicity of needle-selecting jacks are fitted respectively in needle grooves provided in a rotary cylinder. The jacks have their respective lower ends remote from respective needles, which serve respectively as fulcrums. Each jack has, adjacent its upper end, a butt engageable with a cam face. A spring is provided on the rear side of each jack for biasing the same to bring its butt into engagement with the cam face. A control pin is controlled in operation by a control electromagnet, to carry out needle selection. FIGS. 10 and 11 show a second example as disclosed in Japanese Patent Publication No. 53-1865, in which two kinds of jacks having their respective projections different in position from each other are fitted in each of needle grooves provided in a rotary cylinder. Permanent magnets are arranged on a stationary side at positions corresponding respectively to upper and lower portions of the jacks. The jacks balance under the magnetic force about respective fulcrums at the centers of the respective jacks. Control electromagnets are mounted at positions corresponding respectively to the projections of the respective jacks. The operation of the electromagnets is controlled in response to a signal outputted from a program to destroy the balance, thereby carrying out needle selection.

As described above, the arrangement of the first example is such that the control pin and the spring for urging the jack against the cam face are employed, and friction force due to the pressure of the spring on the rear side of the jack is utilized to prevent the latter from being relieved. Because of such arrangement, a high spring force is required for the control pin to bias the jack against the spring force of the jack spring, resulting in premature wear and fatigue of the control pin. In addition, the high spring force of the control pin exerts a bad influence on the balance of the magnetic force of the needle-selecting electromagnets with respect to demagnetizing solenoids for improving the responsibility of the magnets, thereby making the needle-selecting unit complicated in structure. Moreover, the arrangement of the first example is inconvenient to effect control of three positions including a welt position, a tuck position and a knit position. On the other hand, the above-described second example requires highly accurate management in processing and assembling, in order to accurately maintain contact between the magnets and the jack attracting faces. The management includes management of distances from the fulcrum of each jack to the opposite ends thereof, and management of gaps at the cam face. The above management also includes management of an accuracy of the position of the magnet solenoids. Thus, the second example forces considerable burden upon an operator. In addition, since the second example is so arranged as to balance the magnetic force, strong magnetic force is required for the control electromagnets to separate the jacks from the permanent magnets against the magnetic force thereof in order to control the jacks. This increases the size of the magnets, causing problems in the speed responsibility such as rise of the magnetic force, remanence and the like. Thus, the combination of the magnets is made complicated. Furthermore, in order to maintain the requisite accuracy, it is inevitable for the second example that the construction becomes complicated and the overall size becomes large. This makes it difficult for the needle selector to take a three position structure which requires incorporation of two needle selecting controls in the cam arrangement of one knitting course-one feeder. Such electronically controlled needle selection is not preferable, because the three position structure is formed by two sets of knitting cams so that the number of feeders is reduced by half to lower the productivity. Moreover, it is impossible to apply the second example to an electronic control of operation of a dial.

SUMMARY OF THE INVENTION

It is an object of the invention to provide a needle selector for a knitting machine, in which jacks of the same configuration are employed to enable not only needle selection between two positions with respect to a single feeder, but also selection between three positions, to be optionally carried out by control of electromagnets, which is small in size, compact in structure, and economical, which can increase the number of feeders and can reduce the size of magnets, and which is easy in control of needle selection.

According to the invention, there is provided a needle selector for a knitting machine, which includes a plurality of jacks 5 fitted respectively in needle grooves la so as to control respective needles 4, each of the jacks having an upper end thereof adjacent a corresponding one of the needles, which serves as a fulcrum 5*c*, the jack having substantially at its center a lowering butt 5*b* and a raising butt 5*a* spaced from each other; a groove cam 6 for the jacks arranged on a stationary side and having a needle lowering cam face 6*b* with which the lowering butts 5*b* of the respective jacks are engageable, and a raising cam face 6*a* with which the raising butts 5*a* of the respective jacks are engageable; a control electromagnet 7 arranged at a yarn feeding position on the stationary side and between the lowering butt 5*b* and the raising butt 5*a* of the jack, the control electromagnet being excited in response to a needle-selecting signal to bring the raising butt 5*a* into engagement with the raising cam face 6*a*; a jack holding cam 11 arranged on the side of the control electromagnet 7 in juxtaposed relation to a rocking lower end of the jack 5 at the yarn feeding position on the stationary side, the jack holding cam 11 being magnetized by a permanent magnet 15 to attract the jack 5; and a welt cam 12 arranged in facing relation to the jack holding cam 11 at the yarn feeding position on the stationary side, the welt cam 12 being magnetized by the permanent magnet 15 to attract the jack 5, the welt cam having such a convexly curved face that the convexly curved face brings the jack 5 into contact with the control electromagnet 7 just before the jack 5 reaches a needle-selecting area of the control electromagnet 7 while the convexly curved face relieves the jack 5 before and after the jack 5 reaches the needle-selecting area. The jack holding cam 11 is provided with a nonmagnetic member 16*a* between a position just before the needle-selecting area and a position just after the same. The jack holding cam 11 extends long in the advancing direction of the rearward jack from the needle-selecting area, and attracts the jack so as to prevent the latter from being disengaged from a knitting cam when the butt rises along the knitting cam face. Further, two control electromagnets 7 and 8 may be provided which are spaced from each other a distance integer-times a pitch of the needles, to enable three positions including a welt position, a tuck position and a knit position to be selected. In this case, in order to enable the three-position selection, nonmagnetic members 16*a* and 16*b* or the like are arranged to form respective nonmagnetic regions on the jack holding cam 11, which extend respectively between a position just before a first needle-selecting area and a position just after the same and between a position just before a second needle-selecting area and a position just after the same.

DETAILED DESCRIPTION

A circular knitting machine according to an embodiment of the invention will be described with reference to the drawings.

Figure 1:
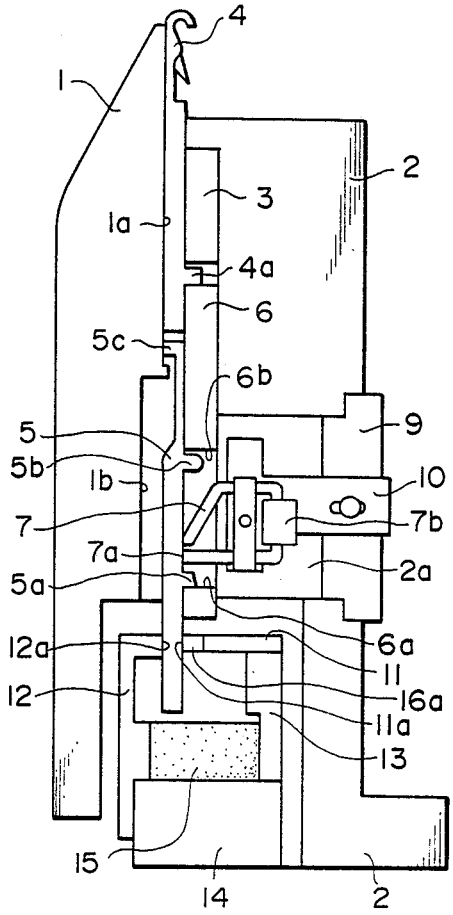
FIG. 1 is a longitudinal cross-sectional view for explanation of the relationship among a cylinder section, a needle and a jack cam section of a circular knitting machine.
Figure 2:
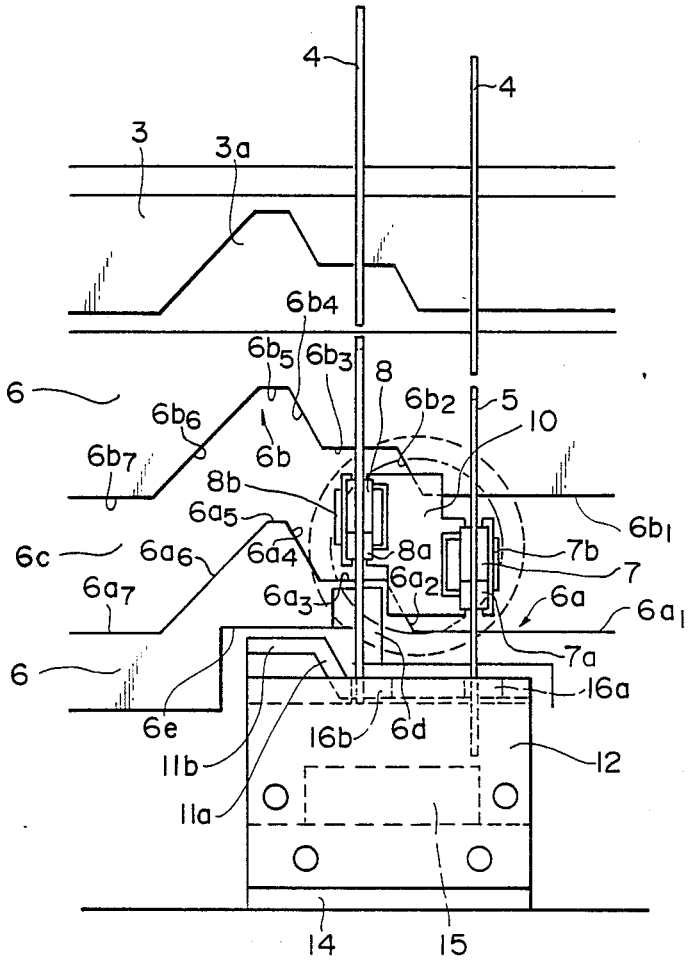
FIG. 2 is a developed view for explanation of the relationship among control electromagnets, cams and jacks.

Referring to FIGS. 1 and 2, the circular knitting machine comprises a rotary cylinder 1 having an outer periphery formed therein with a multiplicity of axially extending needle grooves la spaced in circumferentially equidistantly spaced relation to each other. Needles 4 are fitted respectively in the needle grooves la for axial sliding movement therealong. A cam body 2 is arranged to surround the outer periphery of the cylinder 1 in concentric relation thereto. The cam body 2 has an inner periphery to which a needle groove cam 3 is mounted such that butts 4*a* of the respective needles 4 are in engagement with a cam groove 3*a* in the needle groove cam 3. The cylinder 1 is also formed therein with a multiplicity of grooves 1*b* located respectively below the needle grooves 1*a*. Each groove 1*b* cooperates with a corresponding one of the needle grooves 1*a* to form a pair, and has a depth deeper than that of the needle groove 1*a*. Jacks 5 are fitted respectively in the grooves 1*b* for sliding movement therealong, with a slight gap left between each jack 5 and a corresponding one of the needles 4. The jack 5 has an upper end 5*c* which is inserted into the corresponding needle groove 1*a*. The jack 5 has, substantially at its center, a raising butt 5*a* and a lowering butt 5*b* which are vertically spaced from each other and which project outwardly. The upper end 5*c* of the jack 5 serves as a rocking fulcrum so that the jack 5 is capable of rocking about the upper end 5*c* within the groove 1*b*. The upper end 5*c* is of such a size that the upper end 5*c* is slidable between the bottom of the needle groove 1*a* and the jack groove cam 6. The upper end 5*c* has a corner on the side of the jack groove cam 6, which are formed respectively into slightly curved faces. The jack groove cam 6 for regulating the jacks 5 is mounted on the inside of the cam body 2 and on the lower side of the needle groove cam 3 in such a manner that a planar top of the jack groove cam 6 is confronted with the cam face 3*a* of the needle groove cam 3. The jack groove cam 6 is formed therein with a cam groove 6*c* defined by a raising cam face 6*a* with which the raising butts 5*a* of the respective jacks 5 are engageable, and a needle lowering cam face 6*b* with which the lowering butts 5*b* of the respective jacks 5 are engageable. The cam groove 6*c* has a width which is extremely slightly larger than a distance between a side face of the raising butt 5*a* remote from the needle 4 and a side face of the lowering butt 5*b* adjacent the needle 4, so that the jack 5 is slidable within the cam groove 6*c*. The raising cam face 6*a* and the needle lowering cam face 6*b* are substantially the same in contour as each other. The raising cam face 6*a* has, among other things, lower cam face sections $6a_1$ and $6a_2$ for moving the jacks 5 from a welt position to a tuck position, upper cam face sections $6a_3$ and $6a_4$ for moving the jacks from the tuck position to a knit position, and a cam face section $6a_5$ at the knit position. The needle lowering cam face 6*b* has, among other things, a needle lowering cam face section $6b_6$ for moving the jacks 5 from the knit position to the welt position. The raising cam face 6*a* of the jack groove cam 6 is formed in such a stepped fashion as to have the welt face section (horizontal) $6a_1$, the ascending oblique face section $6a_2$, the tuck face section (horizontal) $6a_3$, the ascending oblique face section $6a_4$, the knit face section (horizontal) $6a_5$, a face section (descending oblique face section) $6a_6$ for restricting the jack at lowering thereof, and a welt face section (horizontal) $6a_7$. The needle lowering cam face 6*b* has its contour substantially the same as the raising cam face 6*a* , and is formed in such a stepped fashion as to have an upper restricting face section (horizontal) $6b_1$ for restricting the jack at the welt position, an upper restricting face section (ascending oblique face section) $6b_2$ for restricting the jack at ascending, an upper restricting face section (horizontal) $6b_3$ for restricting the jack at the tuck position, an upper restricting face section (ascending oblique face section) $6b_4$ for restricting the jack at ascending, an upper restricting face section $6b_5$ for restricting the jack at the knit position, the returning face section (descending oblique face section) $6b_6$, and an upper restricting face section (horizontal) $6b_7$ for restricting the jack at the welt position. The cam face 3*a* of the needle groove cam 3 is formed into a contour substantially the same as the cam faces 6a and 6b. The jack groove cam 6 may be such that a lower section having the raising cam face 6a and an upper section having the needle lowering cam face 6b are formed in an integral manner or in a separate manner.

Figure 4:
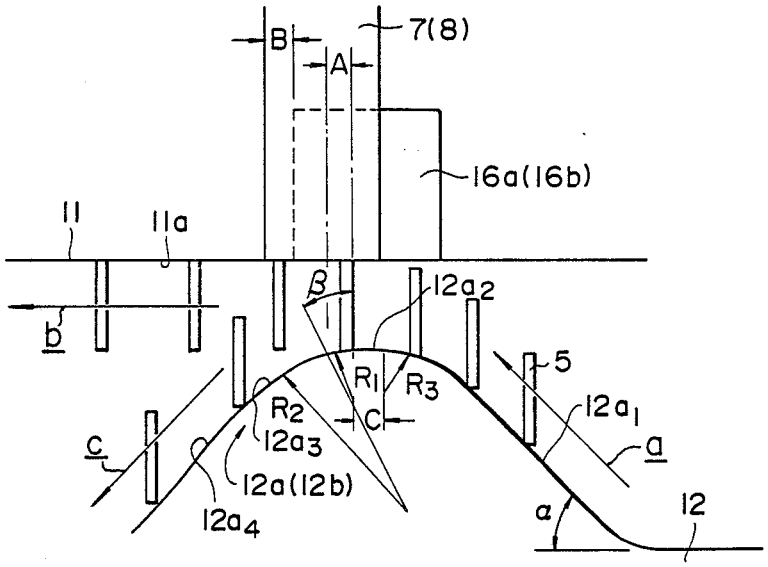
FIG. 4 is an enlarged explanatory view of a needle-selecting portion.
Figure 5:
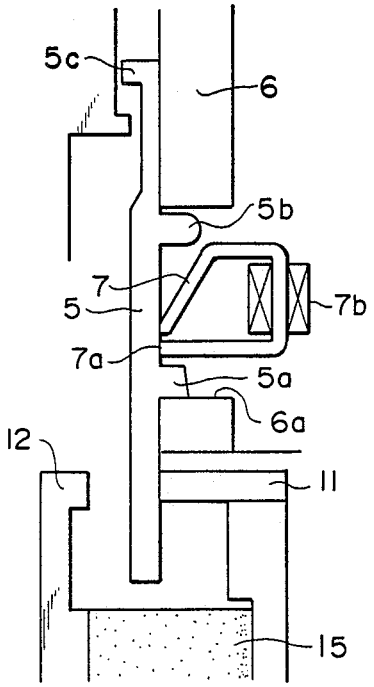
FIG. 5 is a cross-sectional view showing the jack which is brought to a needle-selected position by the control electromagnet.

The cam body 2 is provided therein with windows 2a which correspond respectively to the feeders and which open to the cam groove 6c respectively at needle-selecting areas for the jacks 5. Electromagnet fixing bushes 9 are fitted respectively into the windows 2a. Each of the bushes 9 has mounted thereto a magnet holder 10 for substantially horizontal movement. The magnet holder 10 has fixedly mounted thereon a pair of electromagnets 7 and 8 which are spaced from each other in the running direction of the jacks 5 and which are located at respective positions different in elevation from each other. The electromagnets 7 and 8 are adapted to be operative in response to respective needle-selecting signals from a controller, not shown, to attract the jacks 5. The control electromagnets 7 and 8 are mounted in such a stepped fashion that the control electromagnet 7 on the jack approaching side is located at a lower position and can determine the knit, tuck or welt position, while the control electromagnet 8 on the jack leaving side is located at an upper position and can determine the knit or tuck position. A horizontal interval or spacing between the control electromagnets 7 and 8 is integer-times a pitch of the needles 4. Upper and lower poles of each of the control electromagnets 7 and 8 are confronted with each other, with an extremely slight air gap left therebetween. The control electromagnets 7 and 8 are so mounted as to have their respective poles 7a and 8a which are in flush with or are extremely slightly retracted from the inner peripheral surface of the jack groove cam 6. Each width of the poles 7a and 8a is slightly larger than the needle pitch. Coils 7b and 8b excited in response to the needle-selecting signals are wound respectively around base portions of the respective control electromagnets 7 and 8. End portions, on the jack leaving side, of the respective poles 7a and 8a of the control electromagnets 7 and 8 extend from rearward ends of respective nonmagnetic members 16a and 16b subsequently to be described. The end portion of each of the respective control electromagnets 7 and 8 overlaps a corresponding one of respective magnetized regions of a jack holding cam 11 by an overlapping amount B (preferably 0.5–2 mm) as shown in FIG. 4.

The jack holding cam 11 is arranged on the inside of the cam body 2 and on the lower side of the jack groove cam 6. The jack holding cam 11 is located at such a position that its planar cam face 11a easy in manufacture is flush with the inner peripheral surface of the jack groove cam 6 and at such a position that the cam face 11a is confronted with lower portions of the respective jacks 5 below their respective raising butts 5a. The jack holding cam 11 extends to a position where the jack 5 passes by the knit face section of the raising cam face 6 so as to ensure that the raising butt 5a is in engagement with the raising cam face 6a, i.e., is not disengaged therefrom until completion of the knit work, without the aid of any spring force. A wet cam 12 having a corrugated cam face 12a subsequently to be described is arranged in facing relation to the jack holding cam 11. The welt cam 12 and the jack holding cam 11 cooperate with each other to clamp therebetween the jack 5 in an intimate contact manner at a location just before each of the needle-selecting areas.

The jack holding cam 11 as well as the welt cam 12 is fixedly mounted on a welt cam fixing table 14 through a holding cam support table 13. A permanent magnet 15 is provided between a base portion of the respective holding cam support table 13 and a base portion of the welt cam 12. The permanent magnet 15 is of a size required to magnetize the cam faces 11a and 12a of the respective cams 11 and 12 such that both the cam faces serve respectively as poles for attracting the jack 5 to any one of the cam faces. Each of the nonmagnetic members 16a and 16b is embedded in the jack holding cam 11 in flush with the pole face 11a thereof so as not to interfere with control of the jacks 5 by a corresponding one of the control electromagnets 7 and 8, at respective locations just before and after the needle-selecting area due to the corresponding control electromagnet and at the needle-selecting area. The nonmagnetic region extends from a position just before an exciting region of the control electromagnet to an intermediate position of the exciting region. In place of the nonmagnetic members embedded, it may be considered to employ means for weakening the magnetic force of the cam face 11a serving as the pole, for example, to enlarge the gap. The position of the side edge of each of the nonmagnetic members 16a and 16b on the jack leaving side with reference to the needle-selecting area A (preferably not more than 1.5 mm) is determined such that when the jack 5 is attracted by the relief side of the welt cam 12, the raising butt 5a is not brought into engagement with the raising cam 6a. The cam face 12a of the welt cam 12 confronted with the jack holding cam 11 has two lobes which are located respectively in front of the control electromagnets 7 and 8. Contour of each of the lobes is such that an oblique face section is provided which causes the jack 5 to be moved toward the holding cam 11 as the jack 5 approaches the needle-selecting area A, a top face section is formed which is substantially planar and which cooperates with the cam face 11a to clamp the jack between the pole cam faces 11a and 12a at a position just before the jack enters the needle-selecting area A, and a curve face section is subsequently provided which retreats away from the cam face 11a of the jack holding cam 11.

The groove cam 6 is formed therein with a recess 6d which serves as a relief for preventing the raising butt 5a of the jack 5 from interfering with the jack groove cam 6 when the jack 5 having been advanced while maintaining the welt position without being attracted by the control electromagnet 7 at the first needle-selecting position is urged by the cam lobe 12b of the welt cam 12 at the second needle-selecting position. In addition, the pole cam face 11a of the jack holding cam 11 has a face section 11b higher in elevation than the remaining face section. The face section 11b serves to attract the lower end portion of the jack 5 toward the jack holding cam 11 when the jack 5 moves upwardly from the tuck position to the knit position. Thus, it is ensured that when the jack 5 ascends along the cam face 6a, the holding cam 11 attracts the jack 5 at the knit position so that the jack holding cam 11 extends to a position beyond the knot ascending cam face section of the cam face 6a of the jack groove cam 6.

FIG. 4 specifically shows the relationship among each pole 7a, 8a, each nonmagnetic member 16a, 16b, the welt cam face 12a, the needle-selecting area A, and the overlapping amount B of each of the poles 7a and 8a.

Figure 3:
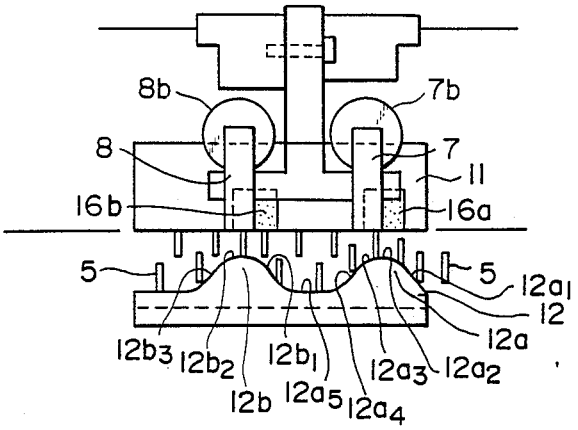
FIG. 3 is an explanatory view showing the relationship in plane among a welt cam, a jack holding cam and the electromagnets.

FIG. 3 shows the positional relationship between the first control electromagnet 7 having its center displaced toward the jack leaving side from the top face section of the first lobe face 12a, and the second control electromagnet 8 having its center displaced likewise from the top face section of the second lobe face 12b. The nonmagnetic regions are located in facing relation respectively to the first lobe 12a and the second lobe 12b in order to enable control of the jacks by the control electromagnets. The pitch of the first and second lobes 12a and 12b and the spacing or interval between the first and second control electromagnets 7 and 8 are integer-times the needle pitch. The contour of the welt cam 12 has an important relationship to the rotational speed of the cylinder 1, the control pulse frequency of the control electromagnets 7 and 8, and the attracting force of the solenoids.

As shown in FIGS. 3 and 4, the welt cam 12 is such that the first lobe 12a on the jack approaching side of the first needle-selecting area, for example, has an approaching oblique face section $12a_1$ approaching the jack holding cam 11 at an angle $\alpha°$ (preferably 30–45°),a top face section $12a_2$ just before the needle-selecting area, and a small curved face section having a radius $R_3$ (preferably not more than 5 mm) located short of the top face section $12a_2$. The top face section $12a_2$ is continuous to the small curved face section and is a planar face section having a width C (preferably not more than 2 mm). The spacing between the planar face section $12a_2$ of the width C and the nonmagnetic member 16a within the holding cam 11 is accurately set to such a size as to clamp the jack 5 therebetween. The setting of the size is carried out by the use of a gap setting jig. The first cam lobe 12a further has a small curved face section which is continuous to the planar face section $12a_2$ and which has a radius $R_1$ (preferably not more than 5 mm). The small curved face section extends through an angular extent of $\beta°$ (preferably 15–30°) corresponding to the needle-selecting area A. Continuous to the small curved face section is a curved face section which has a radius $R_2$ (preferably 8–15 mm) and which forms an evacuating oblique face section $12a_3$. The evacuating oblique face section $12a_3$ is continuous to a planar face section $12_5$ serving as a full release face section, through a curved face section $12a_4$ having a reversed radius. The second lobe 12b having the contour similar to the first lobe 12a is formed at the second needle-selecting area.

The magnitude of the radius $R_1$ and the magnitude of the angle $\beta$ have an important relationship to a working limit rotational speed gage of the cylinder 1 in relation to the magnetic force of each of the control electromagnets 7 and 8. That is, if the radius $R_1$ is zero, the jack 5 would ascend by the raising cam 6a along the holding cam 11 without the necessity of the magnetic force of the control electromagnet 7 or 8, and without moving along the welt cam 12. The higher the rotational speed of the cylinder 1, the more such tendency is seen. That is, if the radius $R_1$ is zero, the magnetic force of the welt cam 12 does not act upon the jack. Accordingly, the magnitude of the radii $R_1$ and $R_2$ and the magnitude of the angle $\beta$ are determined such that when supply of electric current to the control electromagnets 7 and 8 is interrupted, all of the jacks are brought to the welt position at the working limit rotational speed of the cylinder. The needle-selecting width A seriously influences the radius $R_1$, and an inclination of the arc of the radius $R_2$ seriously influences the reliability of movement of the jack 5 along the welt cam 12 with respect to the rotational speed of the cylinder 1. That is, the rocking moment of the jack 5 has relation, in particular, to the radius $R_1$, the angle $\beta$, and the excitation power of the control electromagnets. By this reason, the minimum value of the radius $R_1$ is determined, inclusive of the jack moment and a slight frictional force. It is important to ensure that all of the jacks are brought to the welt position in the unexcited state of the control electromagnets. To bring the radius $R_1$ to a minimum allowable value enables the needle-selecting width A to be shortened to improve the responsibility of the needle selection. Although the illustrated embodiment has been described as having the jacks 5 each of which has its upper end 5c serving as a fulcrum, it is not impossible to turn the arrangement upside down. In addition, if the jack holding cam 11 is provided with no nonmagnetic regions, consideration must be made to the magnetic force of the welt cam 12 with respect to that of the jack holding cam 11 such that the jack 5 is attracted toward the welt cam 12 when no needle-selecting signal is inputted to the control electromagnets 7 and 8.

The operation of the needle selector constructed as above will be described below.

Figure 6:
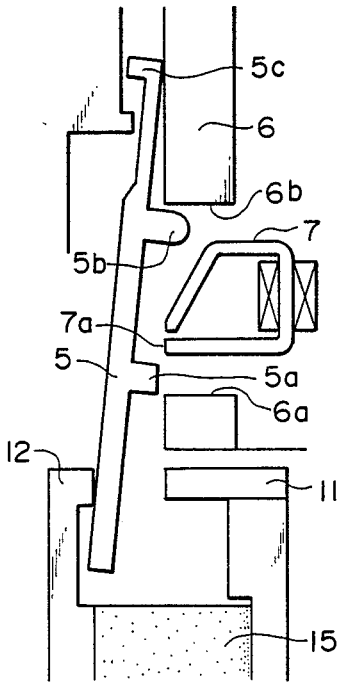
FIG. 6 is a view similar to FIG. 5, but showing the jack which is in a needle-unselected position.

As the cylinder 1 rotates from the right to the left as viewed in FIG. 2, the needles 4 fitted respectively in the needle grooves la and the jacks 5 move with rotation of the cylinder 1 such that the jacks 5 run in the circumferential directions a and b or in the circumferential directions a and b as shown in FIG. 4. The butts 4a of the respective needles 4 run within the cam groove 3a of the needle groove cam 3. On the other hand, before the needle-selecting area, the jacks 5 run in such a fashion that, as shown in FIG. 6, the jack 5 is attracted to the pole cam face 12a of the welt cam 12 about the fulcrum at the upper end 5a, with the lowering butt 5b in contact with or in close to the needle lowering cam face 6b of the jack groove cam 6 and with the raising butt 5a displaced out of the raising cam face 6a.

An all-welt mode of operation will first be described in which no needle-selecting signal is inputted into any of the control electromagnets 7 and 8. In this all-welt mode, as the cylinder 1 rotates, the jack 5 is urged toward the pole cam face 11a of the holding cam 11 by the approaching oblique face section $12a_1$ of the lobe 12a at the first needle-selecting position, which approaches the needle-selecting area along the welt cam 12. The jack 5 is clamped between the pole top face section $12a_2$ and the pole cam face 11a. Subsequently, the jack 5 enters the first needle-selecting area A, but the jack 5 is attracted to the pole cam face 12a of the welt cam 12, because the control electromagnet 7 is not excited and because the pole cam face 11a of the holding cam 11 is brought to the nonmagnetic state by the nonmagnetic member 16a. Thus, the jack 5 evacuates from the position of the radius $R_1$ of the first lobe 12a along the evacuating oblique face section $12a_3$ of the radius $R_2$. Since the nonmagnetic member 16a is embedded to the position where the jack attracted by the pole of the welt cam 12 is not attracted by the pole of the jack holding cam 11, the jack 5 moves along the cam face of the welt cam 12 without being restricted by the pole cam face 11a of the holding cam 11. Since the ascending oblique face section $6a_2$ of the raising cam 6a rises from a point of time the raising butt 5a of the jack is completely displaced out of the raising cam 6a, the jack which is not attracted to the holding cam 11 runs along the pole cam face 12a of the welt cam 12. Since the control electromagnet 8 at the second needle-selecting area is not also excited, the jack 5 likewise runs along the pole cam face 12b of the welt cam 12. Thus, the jack 5 is not pushed up and does not raise the corresponding needle 4, so that the needle 4 and the jack 5 move in the welt state about the axis of the cylinder 1 together with the same, and run respectively along the inner peripheral surface of the needle groove cam 3 and the inner peripheral surface of the jack groove cam 6.

A mode of operation will next be described in which a needle-selecting signal is inputted into the control electromagnet 7 so that needle selection is made to the tuck work. The magnetic force of the welt cam 12 and the magnetic force of the control electromagnet 7 act upon the jack 5 clamped between the cam face 11a of the jack holding cam 11 and the top face section $12a_2$ of the first lobe 12a of the welt cam 12. In this state, the jack 5 enters the needle-selecting area A, with rotation of the cylinder 1, and runs in such a fashion that the jack 5 is attracted to and is selected toward the holding cam 11 under the strong magnetic force of the control electromagnet 7 against the pole cam face 12a of the welt cam 12. Since the end of the control electromagnet 7 has the overlapping amount B, the jack 5 continuously runs straight under the attracting force of the pole cam face 11a of the jack holding cam 11. The raising butt 5a of the jack 5 is pushed up by the ascending cam face section $6a_2$ of the jack groove cam 6 to push the needle 4 up, so that the jack 5 is moved into the tuck position at the ascending cam face section $6a_3$, thereby bringing the needle 4 into the tuck state.

A mode of operation will be described in which the needle-selecting signal is also inputted into the control electromagnet 8 so that needle selection is made to the knit work. In case where the needle selected toward the holding cam 11 at the first needle-selecting area A is again selected toward the holding cam at the second needle-selecting area, a delayed timing signal, which is delayed integer-times the needle pitch that is the spacing between the control electromagnets 7 and 8, is inputted into the control electromagnet 8. The jack 5 needle-selected at the first needle-selecting area is on the horizontal face section $6a_3$ of the raising cam face 6a, and is urged toward the pole cam face 11a of the jack holding cam 11 by the approaching oblique face section $12b_1$ of the second lobe 12b of the welt cam 12. After the jack 5 has been clamped between the top face section $12b_2$ and the jack holding cam 11, the jack 5 is attracted toward the jack holding cam 11 under the strong magnetic force of the control electromagnet 8 at the second needle-selecting area A, in a manner like the first needle-selection. The jack 5 is attracted to the pole cam face 11a of the holding cam 11 by the overlapping amount B while being attracted to the pole 8a of the control electromagnet 8, and continuously runs straight. The raising butt 5a is pushed up to the knit position by the ascending oblique face section $6a_3$, to further push the needle 4 up, so that the needle 4 carries out the knit work at the cam face section $6a_4$. The upwardly shifted pole cam face section 11b at the terminating end of the holding cam 11 ensures that the jack 5 pushed up at the second needle selection is attracted to the pole cam face 11b of the holding cam 11 also at the knit position. Meanwhile, the jack 5 is run smoothly by the needle lowering cam face 6b without being disengaged from the raising cam face. Subsequently, the butt 5b moves along the descending oblique face section $6b_6$ of the needle lowering cam face 6b of the jack groove cam 6 such that the jack 5 is returned smoothly without being disengaged from the descending cam face section $6b_6$ because of the ascending cam face section $6a_6$.

In case where the needle-selecting signal is not inputted into the second control electromagnet 8 so that the jack 5 needle-selected by the first control electromagnet 7 is not needle-selected toward the knit side, the jack 5 in the tuck position is attracted toward the welt cam 12 by the evacuating oblique face section $12b_3$ of the second lobe 12b, so that the ascending butt 5a is disengaged from the raising cam face 6a. Thus, the jack 5 runs as it is by the frictional force at the needle groove, and descends at a point of time the raising butt 5a is brought into contact with the descending oblique face section $6b_6$ of the needle lowering cam face 6b. Thus, the jack 5 is returned to the welt position so that the jack 5 moves about the axis of the cylinder 1 together with the same and runs along the inner peripheral surface of the jack groove cam 6.

Figure 7:
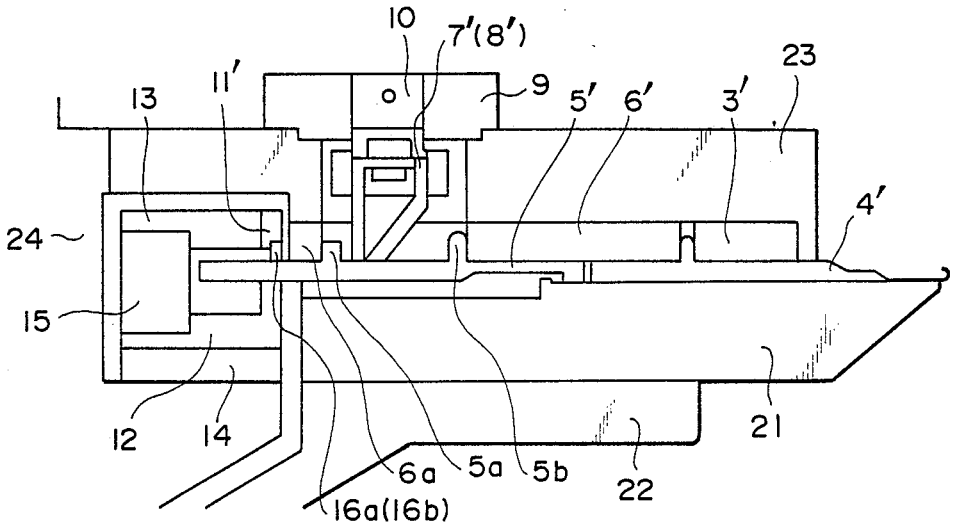
FIG. 7 is a cross-sectional view for explanation of the invention applied to a dial.
Figure 8:
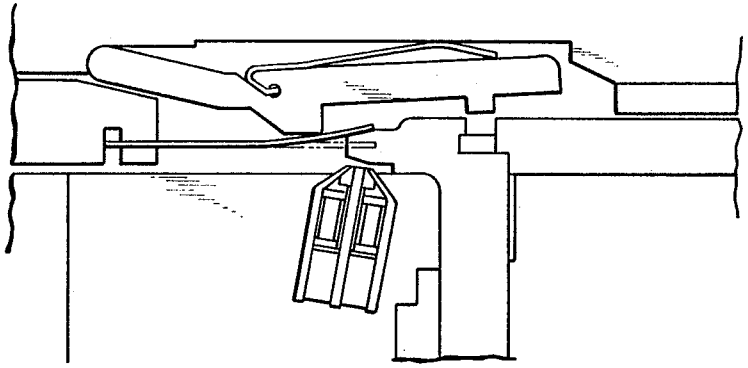
FIG. 8 PRIOR ART
FIG. 8 is a cross-sectional view of a first prior art example, in which a jack is in a needle-unselected position.
Figure 9:
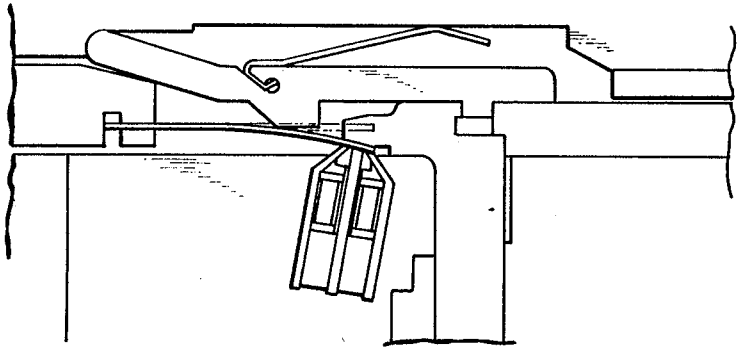
FIG. 9 PRIOR ART
FIG. 9 is a view similar to FIG. 8, but showing the jack in a needle-selected position.
Figure 10:
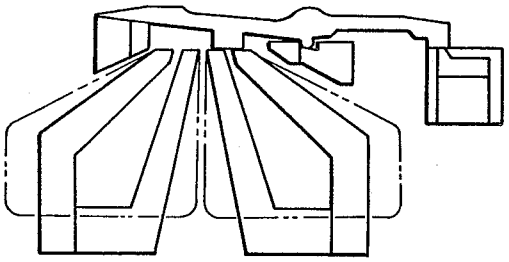
FIG. 10 PRIOR ART
FIGS. 10 and 11 are cross-sectional views of a second prior art example, in which jacks are in a needle-selected position.
Figure 11:
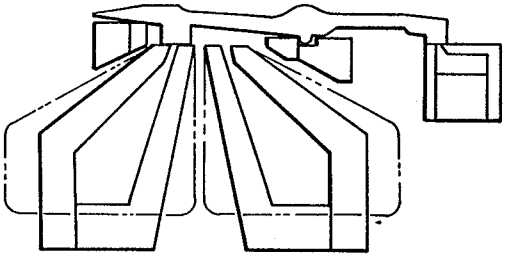
FIG. 11 PRIOR ART

Although the embodiment has been described with reference to the three position control, it is needless to say that the embodiment is applicable to the two position control. In addition, it is of course that the invention is applicable to two position control or three position control in a dial as shown in FIG. 7. In FIG. 7, a rotary dial 21 is fixedly mounted to a rotary cylinder 22, and is rotatable together with the rotary cylinder 22 about its axis. A dial cam body 23 having fixedly mounted thereon a needle cam 3' and a jack groove cam 6 is maintained stationary by a dial support 24. The dial 21 has a top surface formed therein with a multiplicity of radially extending grooves into which a plurality of pairs of needles 4' and jacks 5' are slidably fitted respectively. The needles 4' have their respective butts which are inserted into a groove in the needle cam 3'. On the other hand, each of the jacks 5 has a pair of butts which are inserted into a groove in the jack groove cam 6'. Control electromagnets 7' and 8' are arranged in a positional relationship like the previous embodiment described with reference to FIGS. 1 through 6. A jack holding cam 11', a welt cam 12', permanent magnets 15'and nonmagnetic members 16a and 16b are arranged like the previous embodiment. These component parts operate in a manner similar to the case of the previously described cylinder 1. Moreover, the invention is applicable to a needle bed of a flat knitting machine.

As described in detail above, the arrangement of the needle selector according to the invention is such that the jack holding cam and the welt cam are located at the yarn feeding position in such a fashion as to clamp the jack between the magnetized cam faces of the respective cams and to move the jack between both the cams, and the control electromagnets are located at the same yarn feeding position. With such arrangement, the jacks having the same configuration are employed to enable not only needle selection of two positions with respect to a single feeder, but also selection of the three positions to be optionally carried out by the control of the electromagnets. In addition, since springs for backing up respective jacks, control pins and the like are not employed, the needle selector according to the invention does not become large in size unlike the conventional three position control mechanism, but can be made small and compact in size. Further, the number of expendable component parts can be reduced to raise the economical efficiency. It is also possible to increase the number of feeders. Moreover, the jack holding cam and the welt cam have their respective magnetized cam faces which are arranged at the ends of the respective jacks remote from their respective rocking fulcrums, to retain the position of the needle-selected jacks and the needle-unselected jacks. Thus, the magnetic force of the electromagnets can be reduced, making it possible to reduce the size of the electromagnets and making it possible to facilitate the needle-selecting control.

What is claimed is:

1. A needle selector for a knitting machine, comprising:

a plurality of jacks fitted for movement respectively in needle grooves formed in a needle bed, so as to control respective needles, each of said jacks having one end thereof serving as a fulcrum about which the jack is capable of rocking, the jack having a butt;

a jack groove cam having a raising cam face for moving said jacks along their respective axes;

a control electromagnetic arranged in facing relation to one of said jacks at a yarn feeding position, said control electromagnetic being excited in response to a needle-selecting signal to attract the jack to bring its butt into engagement with said raising cam face of said jack groove cam;

a jack holding cam arranged in juxtaposed relation to the other rocking end of the jack at said yarn feeding position, said jack holding cam having a cam face which is so magnetized as to attract the jack toward said jack groove cam, said jack holding cam extending to a position beyond a knit face section of said raising cam face of said jack groove cam;

a non-magnetic region provided on said cam face of said jack holding cam and extending between a position just before a needle-selecting area due to said control electromagnet and a position just after said needle-selecting area;

a welt cam arranged at such a position as to clamp the jack between said cam face of said jack holding cam and a cam face of said welt cam just before said needle-selecting area, said cam face of said welt cam being so magnetized as to attract the jack, wherein needle selection is carried out with respect to said jacks passing between said holding cam and said welt cam having their respective cam faces magnetized, in response to presence and absence of the needle-selecting signal to said control electromagnet.

2. A needle selector for a knitting machine as defined in claim 1, wherein said nonmagnetic region extends from a position just before an exciting region of said control electromagnet to a intermediate position of said exciting region.

3. A needle selector for a knitting machine as defined in claim 1 wherein said nonmagnetic region associated with said control electromagnet is formed by a nonmagnetic member embedded in said jack holding cam.

4. A needle selector for a knitting machine as defined in claim 1, wherein said nonmagnetic region associated with said control electromagnet is formed by means for weakening attracting force on said jacks.

5. A needle selector for a knitting machine, comprising:

a plurality of jacks fitted for movement respectively, in needle grooves formed in a needle bed, so as to control respective needles, each of said jacks having one end thereof serving as a fulcrum about which the jack is capable of rocking, the jack having a raising butt;

a jack groove cam having a cam face for moving said jacks along their respective axes;

a first control electromagnet arranged in facing relation to one of said jacks located at a welt position, which control electromagnet is disposed at a yarn feeding position, said first control electromagnet being excited in response to a needle-selecting signal to attract the jack to bring its raising butt into engagement with a tuck ascending cam face section of said cam face of said jack groove cam;

a second control electromagnet arranged in facing relation to the jack at the same yarn feeding position, the jack being in a tuck position at a location which is spaced integer-times a pitch of said needles from said first control electromagnet in a direction of the forward movement of said jacks, said second control electromagnet being excited in response to a needle-selecting signal to attract the jack to bring its raising butt into engagement with a knit ascending cam face section of said cam face of said jack groove cam;

a jack holding cam arranged in juxtaposed relation to the other rocking end of the jack at said yarn feeding position, said jack holding cam having a cam face which is so magnetized as to attract the jack towards said jack groove cam, said jack holding cam extending to a position beyond the knit ascending cam face section of said cam face of said jack groove cam;

a pair of first and second non-magnetic regions provided on said cam face of said jack holding cam, said first second and second non-magnetic regions extending between a position just before a first needle-selecting area due to said first control electromagnet and a position just after said first needle-selecting area and between a position just before a second needle-selecting area due to said second control electromagnet and a position just after said needle-selecting area, respectively;

a welt cam arranged at such a position as to clamp the other rocking end of the jack between said cam face of said jack holding cam and a cam face of said welt cam correspondingly just before said needle-selecting area and just before said second needle-selecting area, said cam face of said welt cam being so magnetized as to attract the jack.

wherein said jacks passing between said holding cam and said welt cam having their respective cam faces magnetized can select the welt position, the tuck position and a knit position, in response to presence and absence of the needle-selecting signal to said first control electromagnet and the needle-selecting signal to said second control electromagnet, which is delayed integer-times the needle pitch.

6. A needle selector for a knitting machine as defined in claim 5, wherein each of said nonmagnetic regions extends from a position just before an exciting region of a corresponding one of said first and second control electromagnets to a intermediate position of said exciting region.

7. A needle selector for a knitting machine as defined in claim 5, wherein each of said first and second nonmagnetic regions associated with a corresponding one of said first and second control electromagnets is formed by a nonmagnetic member embedded in said jack holding cam.

* * * * *